United States Patent [19]

Altorfer et al.

[11] 4,102,541

[45] Jul. 25, 1978

[54] ROLLER SKIS

[75] Inventors: Hans Altorfer, Effretikon; Oscar Knoll, Tagelswangen, both of Switzerland

[73] Assignee: Altorfer AG Metall- und Apparatebau, Illnau-Effretikon, Switzerland

[21] Appl. No.: 765,152

[22] Filed: Feb. 3, 1977

[30] Foreign Application Priority Data

Feb. 17, 1976 [CH] Switzerland ..... 1890/76

[51] Int. Cl.[2] ..... A63C 17/14

[52] U.S. Cl. ..... 280/11.1 BT; 188/5; 280/11.21

[58] Field of Search ..... 280/11.1 BT, 11.1 R, 280/11.19, 11.2, 11.21, 87.04 A; 188/5, 6

[56] References Cited

U.S. PATENT DOCUMENTS

| | | | |
|---|---|---|---|
| 1,247,801 | 11/1917 | Egge | 280/11.2 |
| 1,745,098 | 1/1930 | Jones | 188/6 |
| 1,801,230 | 4/1931 | Fehre | 280/11.21 |
| 2,148,417 | 2/1939 | Dewan et al. | 280/11.2 |
| 2,170,978 | 8/1939 | Smith | 280/87.05 |
| 2,360,629 | 10/1944 | Varner | 188/5 |
| 2,713,496 | 7/1955 | Ayers | 188/5 |
| 2,828,135 | 3/1958 | Koci | 280/605 |
| 3,884,486 | 5/1975 | Wilje | 280/11.1 R |
| 4,021,052 | 5/1977 | Knowles | 280/11.1 BT |

FOREIGN PATENT DOCUMENTS

| | | | |
|---|---|---|---|
| 800,880 | 7/1936 | France | 280/11.1 BT |
| 195,109 | 3/1965 | Sweden | 280/11.21 |

*Primary Examiner*—David M. Mitchell
*Attorney, Agent, or Firm*—Werner W. Kleeman

[57] ABSTRACT

A roller ski comprising a reverse motion-blocking device composed of an articulated pendulum support which engages with the ground during reverse or rearward travel.

10 Claims, 5 Drawing Figures

ROLLER SKIS

BACKGROUND OF THE INVENTION

The present invention relates to a new and improved construction of a roller ski of the type equipped with a reverse motion-blocking device.

It is already known to the art to equip roller skis with reverse motion-blocking devices constructed as a freewheeling device which prevents the wheels, especially the rear wheels, from engaging in a reverse rotation.

Apart from the technical expenditure and the inherent weight of such freewheeling device, the use thereof only safeguards against the reverse movement of the roller ski for such length of time as the friction between the running surface or tread of the wheels prevented from undertaking a rearward rotation and the ground is sufficient to withstand the forces which strive to allow the roller ski to travel rearwards.

Yet, this friction is dependent upon the properties of the aforementioned running or travel surface and, especially, also upon the condition of the ground upon which the roller ski travels. Additionally, the contact surface of the wheels which are secured against reverse rotation is practically in the form of a point-like contact at the ground, so that there results a limitation in the forces capable of opposing the reverse motion-blocking device formed by a freewheeling device. This drawback is particularly perceivable at upgrades and/or slippery terrain.

SUMMARY OF THE INVENTION

Hence, it is a primary object of the present invention to provide a new and improved construction of roller ski which is not associated with the aforementioned drawbacks and limitations of the prior art.

Another and more specific object of the present invention aims at the provision of a novel construction of roller ski of the previously mentioned type, which not only is of lighter weight and simpler as concerns its technical construction, but also is capable of taking-up larger counter-forces.

Yet another important object of the present invention aims at the provision of a novel construction of reverse motion-blocking device for roller skis which effectively blocks undesired rearward movement of the roller ski, and which blocking device is relatively simple in construction and design, economical to manufacture, extremely reliable in operation and not readily subject to malfunction or breakdown.

Now in order to implement these and still further objects of the invention, which will become more readily apparent as the description proceeds, the roller ski of the present development is manifested by the features that the reverse motion-blocking device constitutes a hingedly connected or articulated pendulum support which, during rearward or reverse movement of the roller ski, engages with the ground. During forward travel the free end of the pendulum support can be trailed along the ground. The pendulum support can be hingedly connected with the rear wheel axle or shaft. If the roller ski comprises two rear wheels arranged to both sides of the rear end of a tread or support board or the like, then advantageously the pendulum support comprises a substantially U-shaped profile member or section arranged between the rear wheels and engaging the rear end of the stand or support board, this U-shaped profile member being freely swingingly suspended at the axle or shaft of the rear wheels.

The end of the pendulum support which is to be trailed along the ground can be provided with a contact or support body formed of an anti-skid material, for instance rubber. The pendulum range of the pendulum support is advantageously limited by the action of at least one stop, which may be ajustable.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
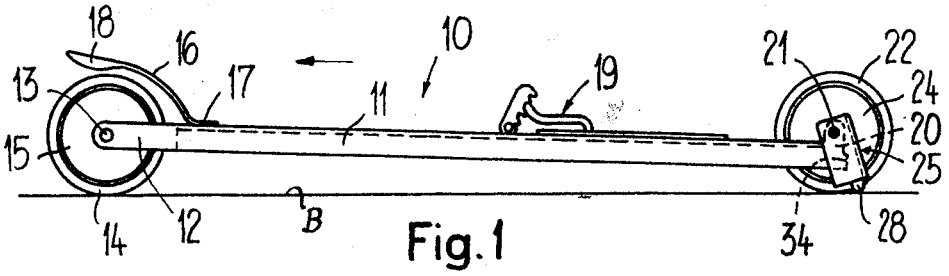
FIG. 1 is a side view of a roller ski having two rear wheels, wherein however for purposes of clarity in illustration the rear wheel closer to the observer has been omitted from the showing.
Figure 2:
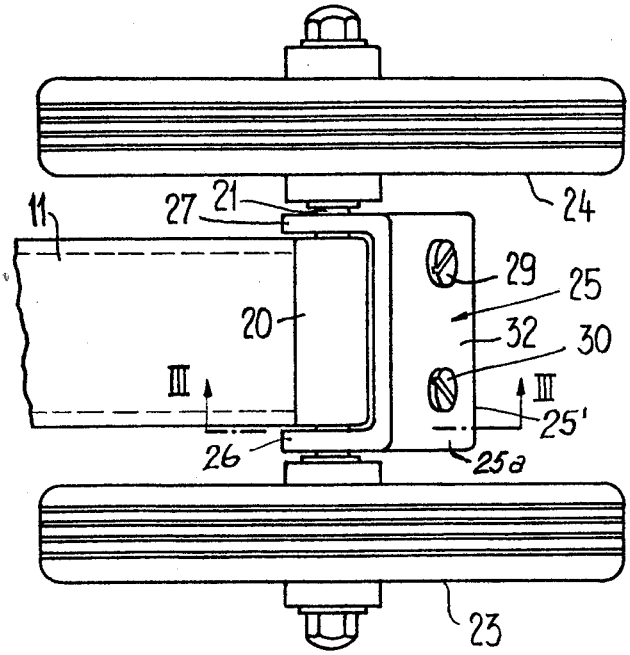
FIG. 2 is an enlarged top plan view of the region containing the rear wheels of the roller ski shown in FIG. 1.

Describing now the drawings, the exemplary illustrated embodiment of roller ski 10 will be seen to comprise a tread or support board 11 which, for instance, is formed by a downwardly open profile or section member or a profile tube composed of light metal, and at the front end of which there is machined away in any suitable fashion the intermediate leg or web, so that the lateral legs each form an overhang arm 12. Between the free ends of the overhang arms 12 there extends a shaft or axle 13 upon which there is freely rotatably mounted a front wheel 15 equipped with a solid rubber tyre 14. Extending over the front wheel 15 in the manner of a fender is a resilient brake bracket 16. This brake bracket 16 is attached at one end, at location 17, in any appropriate manner, for instance by rivets, to the tread or support board 11 and at the other end there is formed a substantially spoon-shaped, upwardly open cup or cup-like member 18. For braking purposes the operator can engage, by means of the tip of the ski pole, the cup member 18 and by exerting pressure can apply the brake bracket 16 at the tyre 14, thereby braking the front wheel 15.

Now at the rear region of the tread or support board 11 or equivalent structure there is attached a cross country ski binding 19 of any suitable construction. At the rear end of the support or tread board 11 there is attached thereto an upwardly extending block 20, through the upper end of which there extends a shaft 21 which protrudes to both sides. At both ends of this shaft 21 there is freely rotatably mounted, for instance by means of a not further illustrated, but conventional plastic journal-bearing bushing, a respective rear wheel 23 and 24 likewise having a solid tyre 22. The height of the block 20 is dimensioned in any case such that the support or standing surface at the binding 19 is located below the plane extending through the axes of the shafts 13 and 21.

Between the block 20 and each of the rear wheels 23 and 24 there is suspended at the shaft 21 a pendulum support 25 which carries out a free pendulum motion. This pendulum support 25 essentially consists of a substantially U-shaped profile or section member 25*a*, both legs 26, 27 of which engage about the block 20 and possess a not particularly referenced bore for the throughpassage of the shaft 21. The pendulum support 25 possesses at its lower end 25' a contact or support body 28, formed in the showing of FIG. 3 of a wear resistant rubber or equivalent material, which, is attached by means of screws 29, 30 or the like and a counter-plate member 31 at the intermediate leg or web 32 of the U-shaped profile member 25*a* in such a manner that it can be easily adjusted in order to compensate for any possible wear. As will be readily apparent from the showing of FIG. 3, during the movement of the roller ski 10 in the direction of the arrow shown in FIG. 1, the pendulum support 25 together with the contact body 28 bearing against the ground is trailed. The spacing between the axis of the shaft 21 to the contact point 33 of the contact body 28, in this case, is somewhat larger than the radius of the running or tread surface of the tyre 22.

Figure 3:
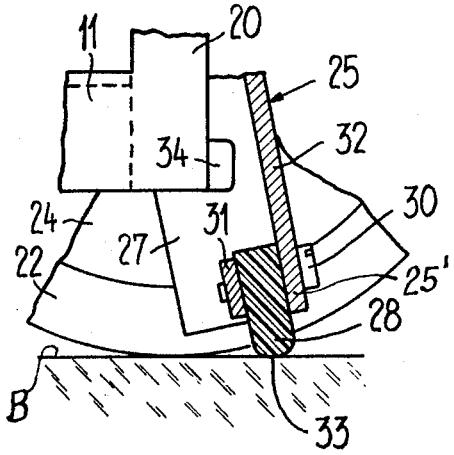
FIG. 3 is a cross-sectional view, taken substantially along the line III—III of FIG. 2.

Now if the roller ski 10, for instance when pushing-off, must take-up forces which could cause a reverse or rearward movement, then the pendulum support 25 wedges at the ground, rocks in clockwise direction in FIG. 3 until striking against a stop 34 (which is advantageously adjustable) provided at the block 20 and lifts the rear end of the roller ski 10 and along therewith the rear wheels 23 and 24 from the ground, so that a reverse movement is no longer possible.

The play until response of the pendulum support 25 can be maintained very small, so that the operator practically does not notice the same.

The point of articulation of the pendulum support 25 need not coincide with the shaft 21. The lower it is situated then the smaller the play which it is possible to maintain until response of the pendulum support.

The fact that the contact body 28 must be adjusted from time to time or replaced, in order to insure the requisite contact of the pendulum support with the ground, is something which can be readily tolerated, especially in view of the afforded advantages, particularly the maintenance work which is not very considerable. Additionally, the possibility exists of exchanging the contact body for different ones, in order to thereby compensate for the encountered properties of the ground and upon which the roller ski should travel.

Instead of the contact body 28 being composed of rubber, it would also be possible to provide one which is equipped with protuberances, for instance in the form of tips or claws. Such an exemplary embodiment has been illustrated in FIGS. 4 and 5.

Figure 4:
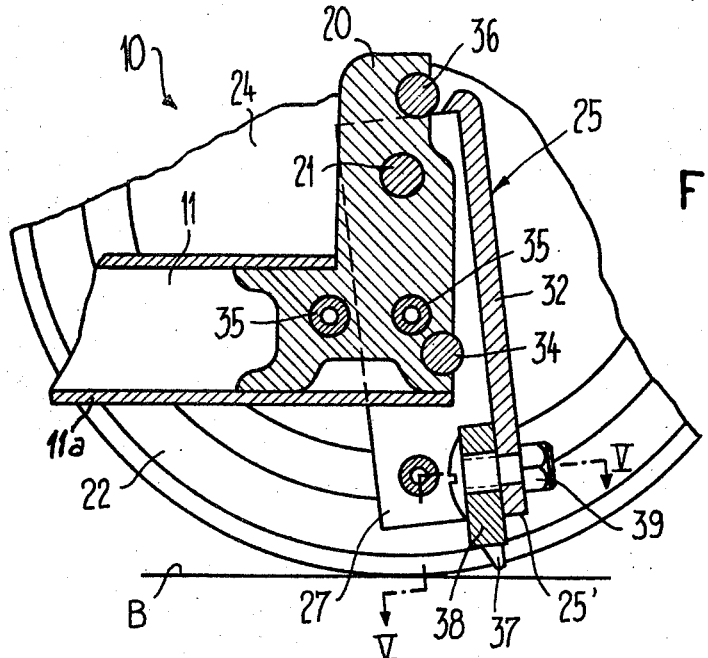
FIG. 4 is a cross-sectional view, similar to the showing of FIG. 3, through a variant embodiment of the invention.
Figure 5:
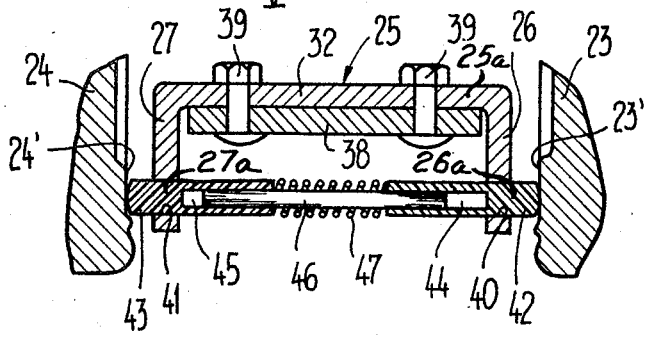
FIG. 5 is a cross-sectional view, taken substantially along the line V—V of FIG. 4.

Now in the showing of FIG. 4 it will be seen that the support or stand board 11 comprises a closed profile tube 11*a*, at the rear end of which there is attached the block 20 by means of two hollow rivets 35. The pendulum support 25, which here also comprises a substantially U-shaped profile or section member 25*a*, is hingedly connected at the shaft or axle 21 of the rear wheels 23, 24 and is pivotable or rockable between a lower stop 34 (here shown in the form of a rubber damper or shock absorber) and an upper stop 36, likewise in the form of a rubber damper or shock absorber. The lower end 25' of the pendulum support 25, in this case, is equipped with the protuberances in the form of the claws or tips, generally indicated by reference character 37, which are fixedly clamped by means of a clamping plate 38 and the bolts 39 or the like at the leg or web 32 of the U-shaped profile member 25*a*. These claws or tips 37 can be formed of a suitable hard material, such as hardened steel or tungsten carbide. With this exemplary embodiment the lower end 25' of the pendulum support 25 and the tips 37, during forward travel of the roller ski, do not bear against the ground B, because otherwise there would be present a bothersome noise or scratchy sound.

Quite to the contrary, the pendulum support 25 of the arrangement of FIG. 4, is coupled by frictional contact with the rear wheels 23 and 24, so that during forward travel of the roller ski 10, the pendulum support 25 is raised until it comes into contact with the stop 36, whereas during rearward travel it is rocked back to the ground or floor B. The frictional coupling of the pendulum support 25 with the rear wheels 23, 24 can be accomplished with not particularly illustrated spring disks arranged between the hubs of the wheels 23 and 24 and the associated legs 26 and 27 respectively. In a particular constructional manifestation according to the illustrated embodiment there is provided at each of the legs 26 and 27 a respective bore 26*a* and 27*a* in which there is mounted to be lengthwise displaceable a respective pin 42 and 43, for instance formed of polytetrafluoroethylene. Guide bores 44 and 45 are provided in the pins 42 and 43 and serve to receive a guide pin 46.

At the inner i.e. confronting ends of the pins 42 and 43 there is supported a compression or pressure spring 47 arranged about the guide pin 46. This compression spring 47 strives to press, with small contact force, the opposed ends of the pins 42 and 43 against the rims 23' and 24' of the associated rear wheels 23 and 24 respectively. The frictional contact which is transmitted by the pins 42 and 43 is practically negligible for the operator or user of the roller ski, but however is sufficient in order to raise the pendulum support 25.

It should be understood that the frictional coupling of the pendulum support with the rear wheels can also be accomplished in a different manner, and that such coupling can be equally provided for the embodiment of FIG. 3, i.e. possessing the rubber contact body 28.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A roller ski equipped with a reverse motion-blocking device, comprising:

a support board having a front end and a rear end;

at least one front wheel mounted at said front end;

rear wheel means mounted at said rear end;

a reverse motion-blocking device embodying a pendulum support engaging with the ground, upon which travels the roller ski by means of the front wheel and said rear wheel means, during reverse motion of the roller ski;

means for hingedly connecting the pendulum support with the roller ski;

means providing two spaced stops carried by said support board at the region of its rear end adjacent the rear wheel means;

said hingedly connecting means mounting said pendulum support to be freely pivotable between said two stops;

said pendulum support having a free end; and means for frictionally coupling the pendulum support at the region of its free end with said rear wheel means for rendering ineffectual the reverse motion-blocking device during forward motion of the roller ski.

2. The roller ski as defined in claim 1, wherein:

said pendulum support has a contact body formed of an anti-skid material provided for said free end of said pendulum support and extending in the direction of the ground for contact therewith when the reverse motion-blocking device is effectual for blocking reverse motion of the roller ski.

3. The roller ski as defined in claim 2, further including:

means for positionally adjusting said contact body to ensure contact thereof with the ground during blocking reverse motion of the roller ski and for compensating for possible wear of such contact body.

4. The roller ski as defined in claim 1, wherein:

said pendulum support has a free end equipped with protruding means for engaging the ground to prevent reverse motion of the roller ski.

5. The roller ski as defined in claim 4, wherein: said protruding means comprise pointed members.

6. The roller ski as defined in claim 5, wherein: said pointed members are formed of a hard material.

7. The roller ski as defined in claim 6, wherein: said hard material is selected from the group consisting of hardened steel and tungsten carbide.

8. A roller ski equipped with a reverse motion-blocking device, comprising:

a support board having a front and a rear end;

at least one front wheel mounted at said front end of the support board;

rear wheels arranged to both sides of the rear end of said support board;

a reverse motion-blocking device embodying a pendulum support engaging with the ground, upon which travels the roller ski by means of the front and rear wheels, during reverse motion of the roller ski;

means for hingedly connecting the pendulum support with the roller ski;

said hingedly connecting means comprising a profile member arranged between said rear wheels and engaging with the rear end of said support board;

said pendulum support has a free end and oscillating about an axis of oscillation;

means for frictionally coupling the pendulum support at the region of its free end at said rear wheels;

said frictionally coupling means comprise pre-biased pin means biased in the direction of the axis of oscillation of said pendulum support and frictionally connected with said rear wheels for rendering ineffectual the reverse motion-blocking device during forward motion of the roller ski.

9. The roller ski as defined in claim 8, wherein:

said pendulum support has a contact body formed of an anti-skid material provided for said free end of said pendulum support and extending in the direction of the ground for contact therewith when the reverse motion-blocking device is effectual for blocking reverse motion of the roller ski.

10. The roller ski as defined in claim 9, further including:

means for positionally adjusting said contact body to ensure contact thereof with the ground during blocking reverse motion of the roller ski and for compensating for possible wear of said contact body.

* * * * *